US006832829B2

(12) United States Patent
Droege et al.

(10) Patent No.: US 6,832,829 B2
(45) Date of Patent: Dec. 21, 2004

(54) INK JET AEROSOL CONTROL USING CARRIER MOVEMENT AS A PISTON PUMP

(75) Inventors: Curtis Ray Droege, Richmond, KY (US); Calvin Dale Murphy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 118 days.

(21) Appl. No.: 10/401,653

(22) Filed: Mar. 28, 2003

(65) Prior Publication Data

US 2004/0189743 A1 Sep. 30, 2004

(51) Int. Cl.[7] ..... B41J 2/215; B41J 2/165
(52) U.S. Cl. ..... 347/83; 347/36
(58) Field of Search ..... 347/83, 36, 74, 347/68, 161, 84

(56) References Cited

U.S. PATENT DOCUMENTS 4,361,845 A 11/1982 Smith
4,419,680 A * 12/1983 Sheridon et al. ..... 347/161
4,668,959 A 5/1987 Jochimsen et al.
4,928,114 A * 5/1990 Fagerquist et al. ..... 347/74
6,017,111 A 1/2000 Kurata
6,241,345 B1 * 6/2001 Ushioda ..... 347/68

FOREIGN PATENT DOCUMENTS

JP 402004511 9/1990

* cited by examiner

*Primary Examiner*—K. Feggins
(74) *Attorney, Agent, or Firm*—Taylor & Aust, P.C.

(57) ABSTRACT

An ink jet aerosol control includes a carrier frame, a carrier, at least one airflow channel and a filter. The carrier is disposed and moveable within the frame and selectively creates a high-pressure zone and a low-pressure zone. The airflow channel joins the high-pressure zone to the low-pressure zone. The filter is disposed in association with the airflow channel.

20 Claims, 3 Drawing Sheets

INK JET AEROSOL CONTROL USING CARRIER MOVEMENT AS A PISTON PUMP

BACKGROUND OF THE INVENTION

1. Field of the Invention

The present invention relates to ink jet printers, and, more particularly, to removing excess aerosol in ink jet printers.

2. Description of the Related Art

An ink jet printer typically includes an ink jet cartridge assembly with a printhead mounted under a body. The body includes one or more ink reservoirs which are in fluid communication with the printhead. The printhead includes a plurality of heaters, which are respectively positioned in association with nozzles in a nozzle plate. The heaters are selectively actuated during printing to jet ink droplets from the corresponding nozzles in the nozzle plate.

Expelling ink through the printhead, during maintenance and printing, releases aerosol. Movement of the printhead causes uncaptured aerosol to swirl within the printer and external to the printer, allowing the aerosol to reach and ultimately rest upon numerous internal and external component parts of the printer and the work area. This contamination is undesirable as it can lead to failure of certain mechanical and electrical components. Uncontrolled release of aerosol is an increasing concern, due in large part to the current trend of decreasing droplet size, since smaller droplets have a greater tendency to stay airborne.

Capture of aerosol is not a new concept in itself. One ink jet printing apparatus includes a carriage moveable within a printer section. Exhaust pipes are positioned on opposite sides of the carriage, relative to the scan directions. A fan draws aerosol droplets from each of the exhaust pipes and through a filter.

Another ink jet printing system includes an ink jet nozzle plate, which jets ink droplets through an elongated slot onto a print medium carried by a drum. A vacuum is applied to a transverse opening positioned above the ink-jetting zone for removing aerosol ink droplets.

A mist reduction system for ink jet printers has a nozzle unit jetting an ink stream at selected ink dot placement locations onto the print medium, which is carried by a drum. A suction pump removes ink mist condensing on a deflection electrode and control electrode and also removes deflected ink from a gutter.

An ink jet recorder includes a recording head, which is moveable in transverse directions relative to a print medium. The recording head includes a pair of air stream ducts positioned on either side of an orifice plate defining a side shooter design with respect to a print medium. A dual fan assembly includes fan blades, which are respectively positioned within the corresponding air ducts. The fan blades are driven, using a rack and pinion arrangement, as the recording head is moved in scan directions relative to the stationary rack. Air is drawn in through air inlet openings and is discharged through air outlet openings associated with each respective fan blade.

Common to each of these systems is the use of active fans or suction pumps with a filter to remove the aerosol. Additional components are generally undesirable, adding to the cost, potential for breakdown, and increased effort in installing and maintaining the system.

What is needed in the art is a manner for controlling ink jet aerosol during maintenance and printing, without the use of an additional fan, to displace harmful aerosols to a filter.

SUMMARY OF THE INVENTION

The present invention relates to an ink jet aerosol control assembly and method using carrier movement as a piston pump for removing aerosols within a printer.

Carrier motion produces airflow required to sweep away the aerosols when the carrier moves from a spitting to a printing position. As the carrier moves from a spit position towards the page, and while the aerosols are still suspended, a high-pressure zone is created in front of the carrier and a low-pressure zone is created behind the carrier. This pressure difference creates airflow from the high-pressure zone to the low-pressure zone. A preferred airflow path, as well as leak paths surrounding the carrier, provides a conduit for airflow to occur. The carrier and geometry surrounding the carrier act as a piston and cylinder to create the pressure difference. The preferred airflow path is most effective while the carrier is over the spit zone. Once exposed, the preferred airflow path is no longer in the flow path between the high-pressure zone and the low-pressure zone. Airflow of sufficient velocity should therefore be provided to collect the aerosols on the filter prior to breaking flow. The manifold area may be created as large as possible to increase the pressure difference between the air inlet (spit zone) and air outlet (manifold).

In another embodiment the carrier is a piston to pump aerosols through a filter associated with an airflow path created at least in part by openings in a printer frame adjacent the carrier. As the carrier moves through the frame, during the printing process, a high-pressure zone is created in front of the carrier, according to its direction of movement and a low-pressure zone is created behind the carrier. Apertures defined in the frame allow air to pass from the high-pressure zone to the low-pressure zone. The air may be filtered in or adjacent the frame to remove airborne aerosol.

An advantage of the present invention is that it is more efficient, channeling airflows that before now had not been used within printing systems and had even been considered detrimental thereto.

Another advantage of the present invention is that the design is simple, replacing expensive components with existing components and wall structures.

A further advantage is that such system eliminates the need for certain components that are subject to wear and breakdown without inducing additional wear on the remaining components.

Yet another advantage is that airflow may be effected without the use of a fan to filter aerosols within the printer.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
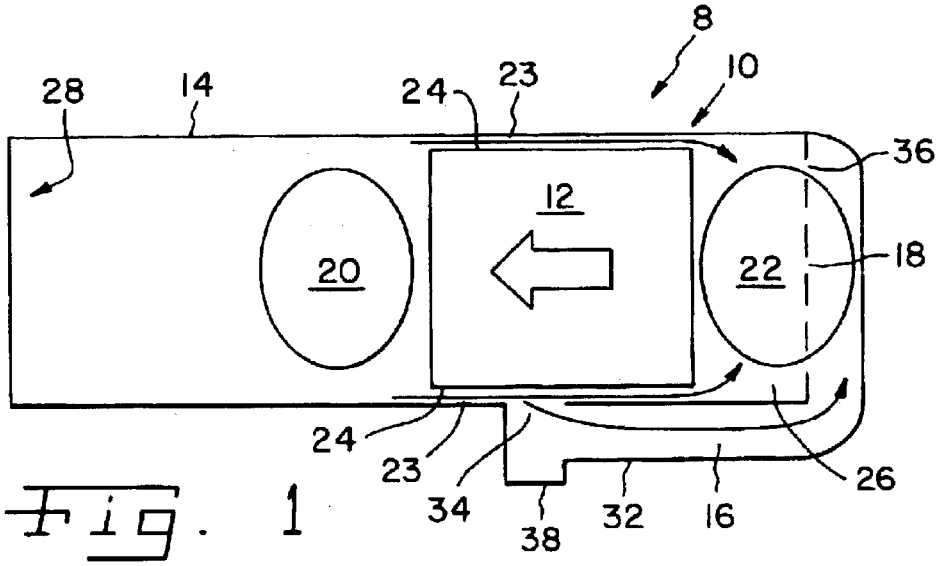
FIG. 1 is a schematic view of a first embodiment of the present invention.

Referring now to the drawings, and particularly to FIGS. 1–4, there is shown an embodiment of a printer 8 including an ink jet aerosol control 10 for collecting airborne aerosol during printing on a print medium (not shown) such as paper, transparency, etc. Ink jet aerosol control 10 generally includes a carrier 12 having an ink jet cartridge assembly, a carrier frame 14, at least one airflow channel 16 and a filter 18.

Carrier 12 periodically releases ink in predetermined locations. Ink jet aerosol is released as part of the expulsion of the ink at such locations. Carrier 12 is generally supported and maintained in carrier frame 14. Carrier 12 generally traverses back and forth along a linear path inside carrier frame 14, creating a high-pressure area 20 in the direction of the movement of carrier 12 and a low-pressure area 22 behind carrier 12. Air tends to move from a high-pressure area 20 to a low-pressure area 22 and accordingly, seeks to move along leak paths 23 defined between outer edges 24 thereof and frame 14. Carrier 12 generally discharges ink in a maintenance area 26 and in a printing area 28.

Frame 14 and channel wall 32 define an airflow channel 16 which may be of any size, shape or configuration suitable for transferring the air from high-pressure zone 20 to low-pressure zone 22, but generally should be constructed based upon available space considerations and aerodynamic considerations, understanding that greater airflow rates provide improved cleaning abilities. An inlet or spit zone 34 provides an entrance to airflow channel 16 and outlet or manifold 36 provides an exit. A well 38 may be defined along a portion of airflow channel 16, sized and positioned to capture the non-airborne particles, i.e. drops of ink condensed from ink jet aerosol 30. Anywhere along airflow path 16 may be a filter 18, from spit zone 34 through manifold 36, although it is generally preferred to position filter 18 between well 38 and manifold 36.

Figure 2:
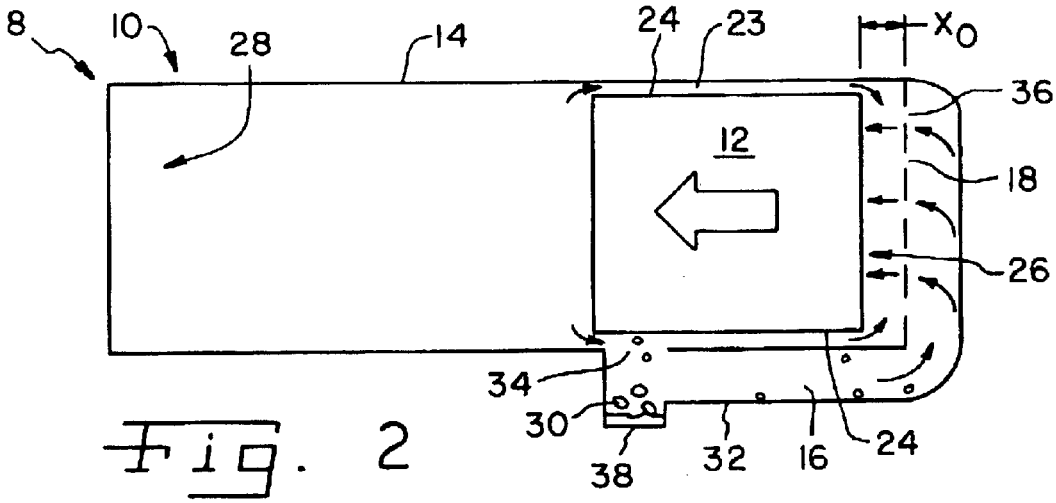
FIG. 2 is a schematic view of the first embodiment, showing the carriage in the maintenance area.

Air is cleaned when carrier 12 moves through maintenance area 26. As carrier 12 initiates movement from maintenance area 26 toward printing area 28, as shown in FIG. 2, airflow through airflow channel 16 is generally at its height.

Figure 3:
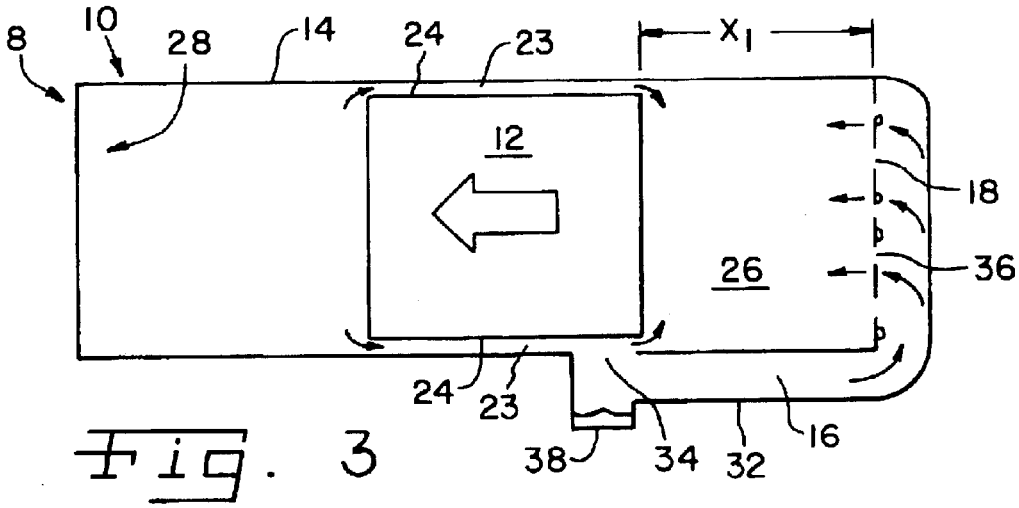
FIG. 3 is a schematic view of the first embodiment, showing the carriage moving from the maintenance area to the printing area.
Figure 4:
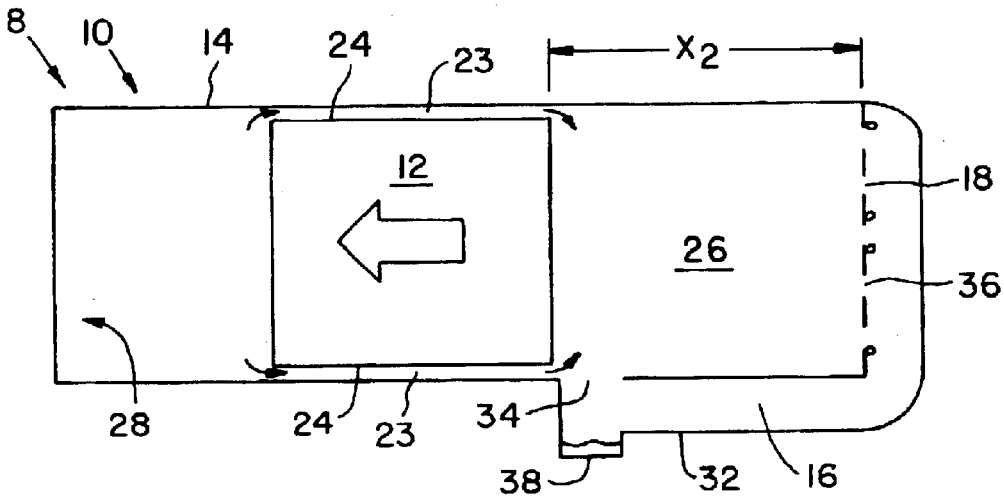
FIG. 4 is a schematic view of the first embodiment, showing the carriage leaving the maintenance area and entering the printing area.
Figure 5:
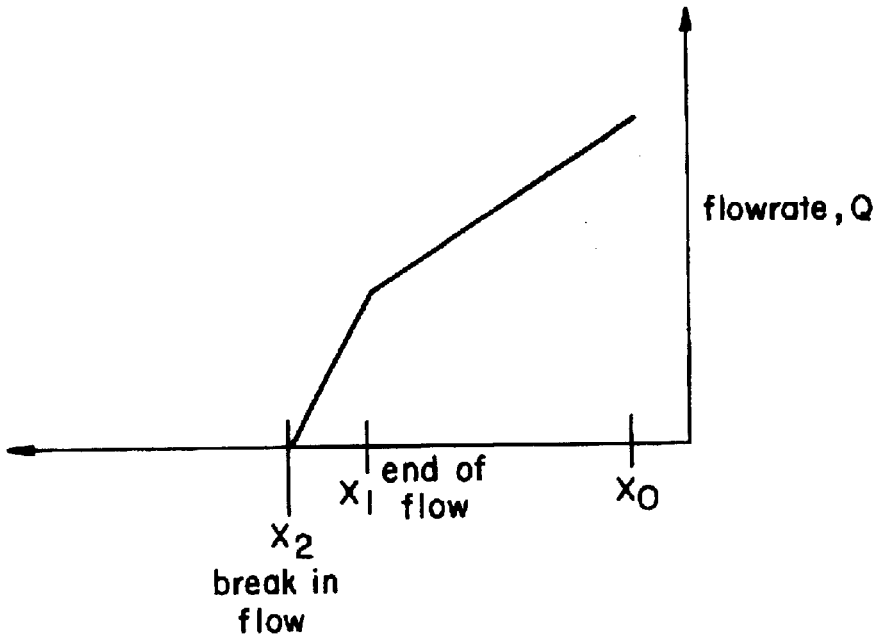
FIG. 5 is a graph showing the rate of airflow versus the position of the carriage for the first embodiment.

The airflow rate decreases as such motion continues as shown in FIGS. 3 and 4. FIG. 5 is a graph of the change in flow rate versus position of carrier 12 where FIG. 2 corresponds to point $X_0$, FIG. 3 to $X_1$ and FIG. 4 to $X_2$. The graph shows the decrease in airflow is related to the effort needed to move air from high-pressure area 20 through airflow channel 16 to low-pressure area 22 as compared to the effort needed to circumvent airflow channel 16 via leak path 23 extending all the way from high-pressure area 20 to low-pressure area 22. Since improved flow rate is desired for increasing cleaning ability, manifold 36 and airflow channel 16 may be made as large as possible, and the proximity of carrier 12 and frame 14 between spit zone 34 and manifold 36 may be made as closed to airflow as possible.

Figure 6:
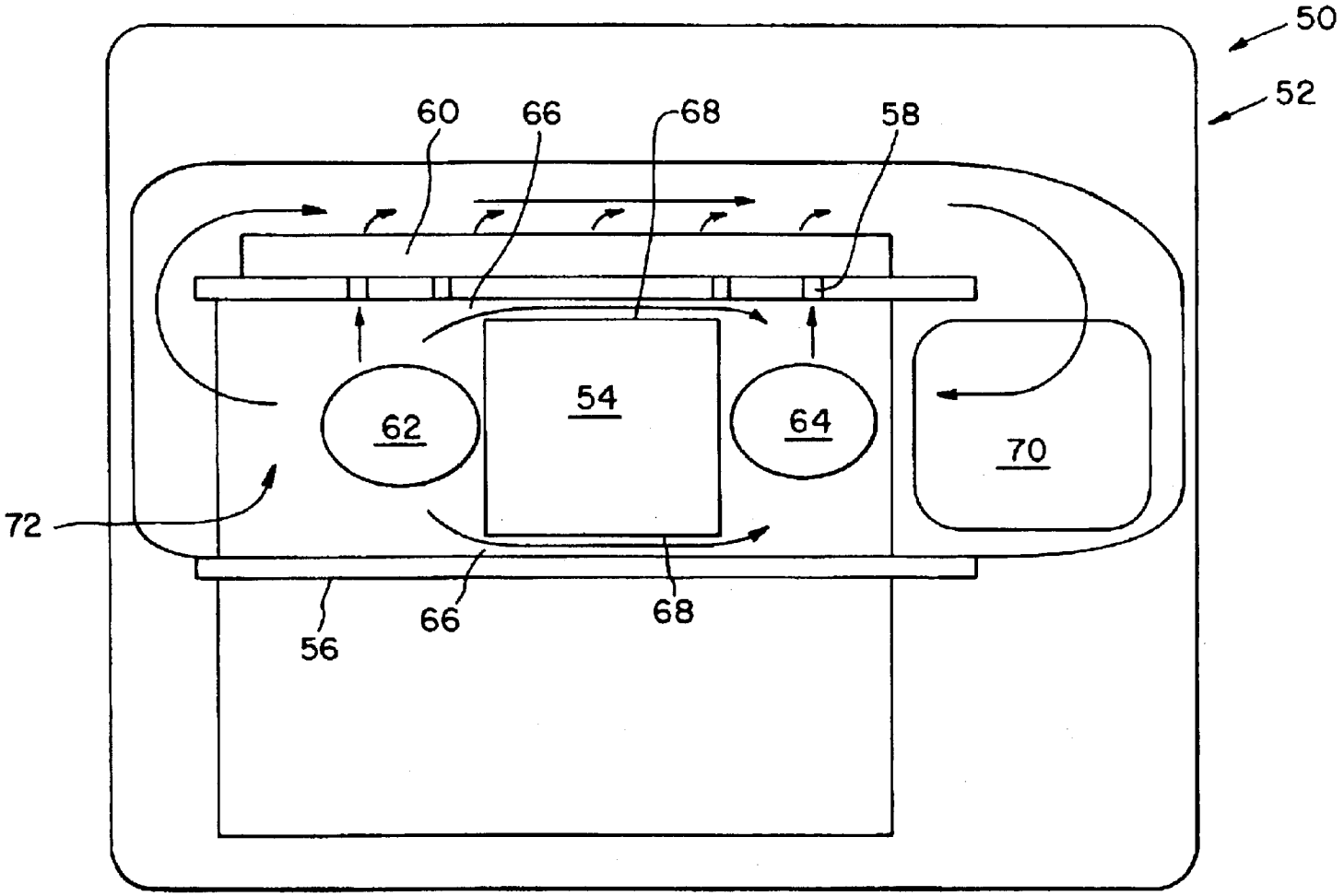
FIG. 6 is a schematic view of a second embodiment of the present invention.

Referring to FIG. 6, a second embodiment, includes a printer 50 with an ink jet aerosol control 52. Ink jet aerosol control 52 collects airborne aerosol during printing on a print medium such as paper, transparency, etc. Ink jet aerosol control 52 generally includes a carrier 54 having an ink jet cartridge assembly, a carrier frame 56, at least one airflow channel 58 and a filter 60.

Carrier 54 periodically releases ink in predetermined locations together with ink jet aerosol. Carrier 54 is generally supported and maintained in carrier frame 56.

Carrier 54 generally traverses back and forth along a linear path inside frame 56, creating a high-pressure area 62 in the direction of the movement of carrier 54 and a low-pressure area 64 behind carrier 54. Air tends to move from high-pressure area 62 to low-pressure area 64 and accordingly, seeks to move along leak paths 66 defined between outer edges 68 of carrier 54 and frame 56. Carrier 54 generally discharges ink in a maintenance area 70 and in a printing area 72.

Frame 56 defines an airflow channel 58 which may be of any size, shape or configuration suitable for transferring the air from high-pressure zone 62 to low-pressure zone 64, but generally should be constructed based upon available space considerations and aerodynamic considerations, understanding that greater airflow rates provide improved cleaning abilities.

In operation, carrier 54 moves in carrier frame 56, creating high-pressure area 62 and low pressure area 64. High-pressure area 62 is positioned adjacent a leading edge of moving carrier 54 and low-pressure area 64 is positioned adjacent a trailing edge of carrier 54. High-pressure area 62 and low-pressure area 64 may switch sides relative to carrier 54, since carrier 54 traverses back and forth in frame 56. Airflows from high-pressure area 62 to low-pressure area 64 through leak paths 66 and at least one airflow channel 58 defined in frame 56. Air is filtered while moving from high-pressure area 62 to low-pressure area 64 through at least one airflow channel 58.

While this invention has been described as having a preferred design, the present invention can be further modified within the spirit and scope of this disclosure. For instance, one may understand that both embodiments may be employed in a single printer. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet aerosol control in an ink jet printer, comprising:

a carrier frame;

a carrier disposed and moveable within said frame, said carrier configured for selectively establishing a high-pressure zone and a low-pressure zone;

at least one airflow channel coupling said high-pressure zone and said low pressure zone; and a filter disposed in association with said airflow channel.

2. The ink jet aerosol control of claim 1, further comprising a manifold mounted to said frame, said filter mounted in said manifold.

3. The ink jet aerosol control of claim 2, wherein said manifold is substantially normal to the direction of movement of said carrier.

4. The ink jet aerosol control of claim 1, wherein said frame defines a spit zone.

5. The ink jet aerosol control of claim 4, further comprising a well in fluid communication with said spit zone.

6. The ink jet aerosol control of claim 1, wherein said carrier is configured to create said high-pressure zone and said low-pressure zone via movement thereof.

7. The ink jet aerosol control of claim 1, wherein said filter is a Venturi filter.

8. The ink jet aerosol control of claim 1, wherein said at least one airflow channel is a plurality of airflow channels.

9. The ink jet aerosol control of claim 1, wherein said frame at least in part defines said airflow channel.

10. An ink jet printer, comprising:

a carrier frame; and an ink jet aerosol control, including:

a carrier disposed within said frame, said carrier configured for selectively creating a high-pressure zone and a low-pressure zone;

at least one airflow channel coupling said high-pressure zone and said low-pressure zone, said first airflow channel being defined in said frame; and a filter disposed in association with said airflow channel.

11. The ink jet aerosol control of claim 10, further comprising a manifold mounted to said frame, said manifold having a second filter mounted therein.

12. The ink jet aerosol control of claim 11, wherein said manifold is substantially normal to the direction of movement of said carrier.

13. The ink jet aerosol control of claim 10, wherein said at least one airflow channel includes a second airflow channel defined by said frame.

14. The ink jet aerosol control of claim 13, wherein a portion of said frame defines said second airflow channel.

15. The ink jet aerosol control of claim 10, further comprising a spit zone defined by said frame, said spit zone having a well in fluid communication therewith.

16. The ink jet aerosol control of claim 10, wherein said carrier is configured to create said high-pressure zone and said low-pressure zone via movement thereof.

17. The ink jet aerosol control of claim 10, wherein said at least one airflow channel comprises at least one pathway through said frame.

18. A method of collecting ink jet aerosol in an ink jet printer, comprising the steps of:

providing a frame and a carrier movably disposed therein;

moving said carrier to create a high-pressure zone and a low-pressure zone;

guiding air from said high-pressure zone to said low-pressure zone; and filtering the air as the air is guided between said high-pressure zone and said low-pressure zone.

19. The method of collecting ink jet aerosol of claim 18, wherein the air is guided through said frame.

20. The method of collecting ink jet aerosol of claim 18, wherein the air is guided adjacent said frame.

* * * * *